US009216567B2

(12) United States Patent
Rogge et al.

(10) Patent No.: US 9,216,567 B2
(45) Date of Patent: Dec. 22, 2015

(54) PRINTING PRESS WITH SEVERAL INKING UNITS

(75) Inventors: Guenter Rogge, Lienen (DE); Frank Gunschera, Osnabrueck (DE); Dietmar Koopmann, Lienen (DE)

(73) Assignee: WINDMOELLER & HOBLSCHER KG, Lengerich (DE)

( * ) Notice: Subject to any disclaimer, the term of this patent is extended or adjusted under 35 U.S.C. 154(b) by 157 days.

(21) Appl. No.: 12/736,977

(22) PCT Filed: May 27, 2009

(86) PCT No.: PCT/EP2009/003746

§ 371 (c)(1),
(2), (4) Date: Dec. 13, 2010

(87) PCT Pub. No.: WO2009/144012

PCT Pub. Date: Dec. 3, 2009

(65) Prior Publication Data

US 2011/0146512 A1 Jun. 23, 2011

(30) Foreign Application Priority Data

May 29, 2008 (DE) ..... 10 2008 025 993

(51) Int. Cl.
*B41F 5/24* (2006.01)
*B41F 13/004* (2006.01)

(52) U.S. Cl.
CPC ..... *B41F 5/24* (2013.01); *B41F 13/0045* (2013.01)

(58) Field of Classification Search
CPC ..... B41F 5/24; B41F 13/004; B41F 13/0045; B41F 13/00; B41F 5/14; B41F 5/18; B41F 5/10; B41F 5/16
USPC ..... 101/182, 212, 248
See application file for complete search history.

(56) References Cited

U.S. PATENT DOCUMENTS

| | | | | |
|---|---|---|---|---|
| 6,334,389 | B1 | 1/2002 | Fischer | |
| 6,474,232 | B1 | 11/2002 | Weschenfelder | |
| 2008/0141886 | A1 * | 6/2008 | Whitelaw et al. | 101/484 |
| 2009/0078134 | A1 | 3/2009 | Rothlein et al. | |

FOREIGN PATENT DOCUMENTS

| | | | |
|---|---|---|---|
| DE | 197 55 316 | A1 | 6/1999 |
| DE | 198 33 467 | A1 | 1/2000 |
| DE | 10 2006 003 013 | A1 | 12/2006 |
| DE | 10 2005 039 782 | A1 | 3/2007 |
| WO | WO 2007/022896 | A1 | 3/2007 |

* cited by examiner

*Primary Examiner* — David Banh
(74) *Attorney, Agent, or Firm* — Jacobson Holman, PLLC.

(57) ABSTRACT

A printing press includes at least one impression cylinder, which has a first and a second front side and to which at least two inking systems each having a print roller are assigned. The print rollers are set against the impression cylinder and each print roller is driven via a drive. A first inking system is assigned to the first half of the impression cylinder and a second inking system is assigned to the second half. The drive of the print roller of the first inking system disposed in the first half is arranged on the first front side of the impression cylinder, and the drive of the print roller of the second inking system disposed in the second half is arranged on the first front side of the impression cylinder.

8 Claims, 1 Drawing Sheet

PRINTING PRESS WITH SEVERAL INKING UNITS

CROSS-REFERENCE TO RELATED APPLICATION

This is a U.S. national stage application of PCT/EP09/003746 filed May 27, 2009, and published in German.

BACKGROUND OF THE INVENTION

1. Field of Invention

The invention relates to a printing press and a method associated therewith as as described herein.

2. Description of the Prior Art

Printing presses, in which a plurality of inking systems is disposed around at least one common impression cylinder, are well-known. These printing presses are primarily used for the printing of flexible materials such as those used for package printing. In these printing presses, these materials are located on the impression cylinder so that they are not subjected to any deformation during the printing process.

Each of the inking systems comprises at least one print roller and at least one ink transfer roller. In flexography, often used in package printing, this ink transfer roller is an anilox roller that removes printing ink from an ink fountain, for example, from an ink chamber blade and applies it to the printing plate attached to the print roller. The ink is transferred from the printing plates onto the printing substrate. Printing presses in recent years have evolved to such effect that an independent drive is assigned to each individual print roller and anilox roller of such an inking system.

A printing press of the type described above is disclosed in DE 10 2005 039 782 A1. DE 197 55 316 A1 discloses a similar printing press, in which an independent drive is assigned to each roller, the individual drives including that of the impression cylinder being disposed in an alternating and staggered form in the axial direction.

Printing presses are known, in which eight or ten inking systems are disposed around an impression cylinder. The impression cylinder is usually mounted for rotation in a central machine frame. The impression cylinder naturally comprises first and second front surfaces, both of which extend in the vertical direction and are parallel to each other. The drive for the impression cylinder is often disposed in the region of any one of the two front sides, which is why this side is referred to as the drive side. The control console for the operating personnel is often provided in the region of the other front side. This side is therefore referred to as the operating side.

When the printing press is viewed at in the direction of one of the front sides of the impression cylinder, the printing press or the actual printing unit can theoretically be divided into two halves. For this purpose, a vertical plane can be assumed that is disposed such that the axis of rotation of the impression cylinder is located in this plane. At least one first inking system is located on one side of this plane, that is, in one half, and at least one second inking system is located in the second half.

In known printing presses, every two inking systems are often disposed and/or constructed symmetrically to the vertical plane. It is therefore necessary to provide different components for each of these two inking systems, which components do not differ in terms of their functionality but are formed so as to be mirror-inverted relative to each other. If every two adjacent inking systems are constructed variably in any one of the two halves, there would consequently be hardly any identical components inside the printing press. For such a printing press, there thus exists a very large number of components, which makes the stocking and the management of these components a laborious and thus expensive process. On the whole, this leads partly to high costs for the production of such a printing press.

DE 198 33 467 A1 therefore discloses an offset printing press, in which two printing units are positioned such that they are rotated through 180° relative to a vertical plane. In doing so, the drive means assigned to the cylinders are also disposed such that they are rotated. However, the aforementioned document does not provide any suggestions for the manner in which the anilox rollers and the drives thereof are to be arranged in order to produce the printing press more cost-effectively.

SUMMARY OF THE INVENTION

It is therefore the object of the present invention to suggest a printing press that can be produced more cost-effectively.

This object is achieved by the features of the invention described herein. Accordingly, provision is made for the drive of the print roller of the first inking system disposed in the first half to be arranged on the first front side of the impression cylinder, and the drive of the print roller of the second inking system disposed in the second half to be arranged on the second front side of the impression cylinder. Provision is further made for each inking system to comprise an anilox roller, which is provided with an independent drive and can be set against the print roller, this drive being disposed at that end of the anilox roller that is located opposite to the end of the print roller at which the drive of the print roller is disposed.

In printing presses of the prior art, all drives of the print rollers are arranged on one side, usually the drive side, so that this arrangement necessitated the provision of different mounting elements for the drive motor for the two halves alone. It is now suggested according to the invention to take two identical print rollers and drives and to install one print roller, for example, in the first half such that the drive is located on the drive side. The second print roller with the associated drive is not arranged in the second half so as to be mirror-inverted to the first print roller, but instead the second print roller is rotated about the vertical axis. As a result, the drive of the second print roller is now located on the operating side. Since print rollers these days are usually replaced by means of crane systems, the arrangement described above does not result in any disadvantages with regard to the operation of the printing press. But the major advantage of this arrangement is that a smaller number of different components have to be provided. This increases the number of standardized components within the printing press, which enables more effective stocking and management of components and consequently leads to a reduction of costs.

Furthermore, since each inking system comprises an anilox roller, which is provided with an independent drive and can be set against the print roller, this drive being disposed at that end of the anilox roller that is located opposite to the end of the print roller at which the drive of the print roller is disposed, the drives for the print roller and the anilox roller are located opposite to each other.

In this way, the installation space for the drives, among other things, is not limited so that the drives would have to be disposed so as to evade each other. In a view of two inking systems that are located opposite to each other relative to the vertical center plane described, the drives of the inking-system rollers are disposed in an alternating manner. All in all, the inking systems can be provided with a more compact construction which leads to a further cost reduction.

According to an advantageous development of the invention, provision is made for the functional components of at least two inking systems, a first of which is assigned to the first half and a second of which is assigned to the second half of the impression cylinder, are identical. Said functional components primarily include the inking-system brackets, the linear guides (for example, rails) that are disposed on the inking-system brackets, the bearing blocks, which can be displaced along these guides and in which the rollers or cylinders are mounted, the components disposed on these bearing blocks, the drives for the rollers and cylinders, the components for the side-lay control, all components for transmitting torque between the drive and the roller or cylinder (for example, gears), locking means for mounting the rollers or cylinders for rotation on the bearing blocks. This list is not exhaustive; it is also feasible to include additional components.

It thus becomes immediately clear that the more the number of identical components in a printing press, the more are the obvious advantages associated therewith.

In a further advantageous embodiment of the invention, at least two inking systems, a first of which is assigned to the first half and a second of which is assigned to the second half of the impression cylinder, are identical. It is particularly advantageous if all the inking systems of the printing press are identical. In this case, even a series production of inking systems can be carried out, without having to allow for the position in the printing press, at which the inking system is mounted, during production. As a result, not only are the costs for stocking the components reduced, but also the entire production process can be formed more effectively since only a small number of different components have to be supplied to the production site.

Additional exemplary embodiments of the invention are revealed in the following description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
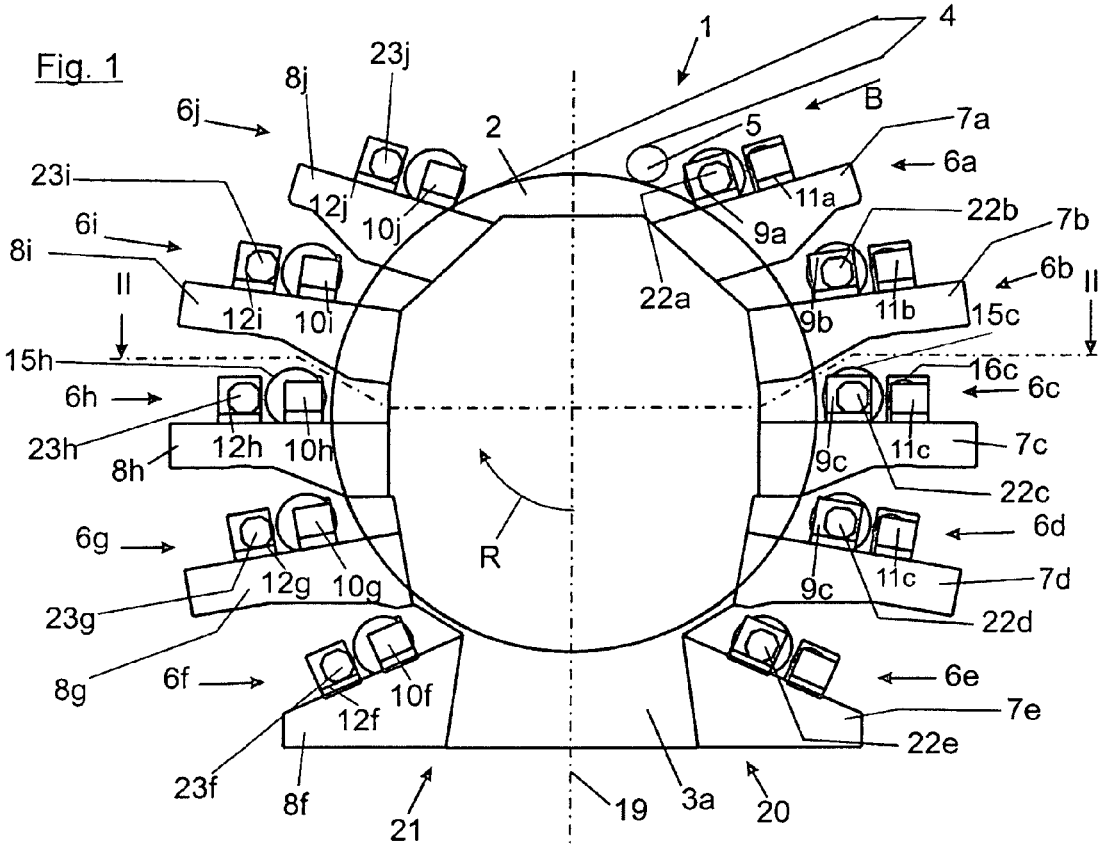
FIG. 1 is a side view of a printing unit of a central impression flexographic printing press

FIG. 1 is a side view of a printing press 1. This printing press is shown in the form of a typical central cylinder flexographic printing press. It comprises a central impression cylinder 2 that is mounted for rotation in a machine frame 3*a*, 3*b*. The web-shaped printing substrate 4 is supplied to the printing press initially in the direction of travel B of the web and is deflected by the pressure roller 5 onto the impression cylinder 2. The impression cylinder rotates in the direction of rotation R so that the printing substrate 4 can be guided past the different inking systems 6*a* to 6*j* one after the other where it is printed by means of printing inks that each correspond to the print motif.

Individual components of an inking system are now described with reference to the inking system 6*c*. The description is also applicable to all other inking systems 6*a*, 6*b* and 6*d* to 6*j*. The inking system 6*c* comprises a front bracket 7*c* and a rear bracket 8*c* (see FIG. 2). Guide elements (for example, guide rails) (not shown in the figures) are mounted on or attached to these brackets. With the help of these guide elements, the bearing blocks 9*c* and 10*c* can be displaced in the direction of the impression cylinder 2, this actuation comprising a component motion in the radial direction of the impression cylinder 2. The actuation of the two bearing blocks 9*c* and 10*c* can be carried out independently of each other. For this purpose, corresponding drives, for example, a motored spindle-spindle nut combination or a so-called linear motor, is provided on each bracket 7*c* and 8*c*. In each bearing block 9*c* and 10*c*, journals 13*c* and 14*c* of the print roller 15*c* are mounted for rotation by means of suitable bearings (not shown in the figures). In the bearing blocks 11*c* and 12*c* that can be moved independently of each other and preferably independently of the bearing blocks 9*c* and 10*c*, the anilox roller 16*c* is mounted for rotation by means of its journals 17*c* and 18*c*.

Two sides can be assigned to the printing press. The side depicted in the side view shown in FIG. 1 is often referred to as operating side BS. The opposite side is accordingly referred to as drive side AS (see FIG. 2).

Figure 2:
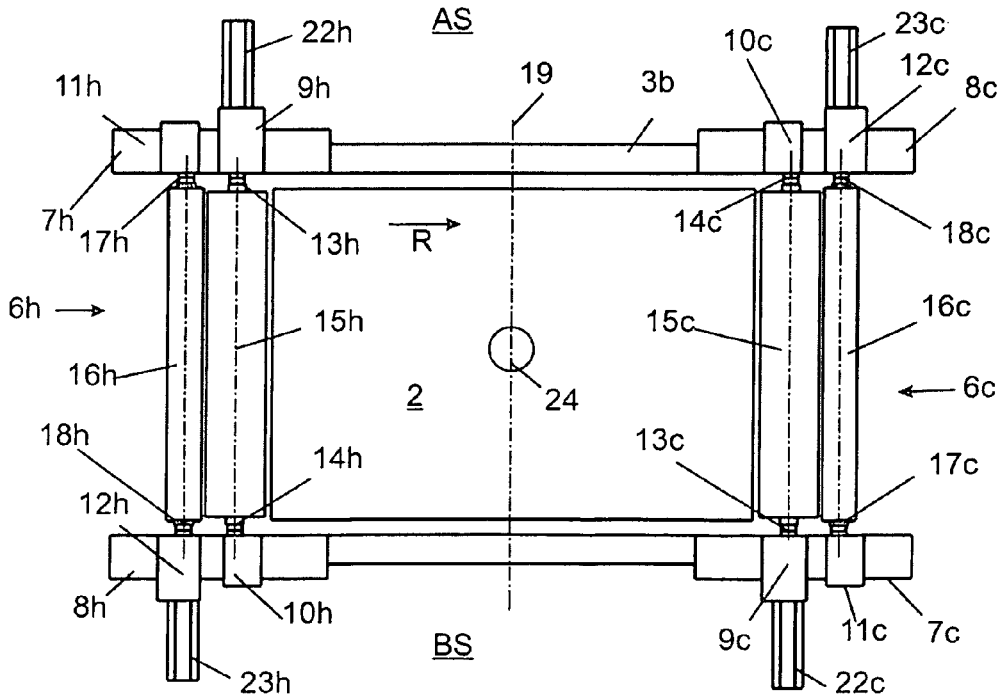
FIG. 2 is a view II-II marked in FIG. 1.

The printing press 1 can be divided into different regions. A vertical center plane 19 that divides the printing press into a right half 20 and a left half 21 is shown in FIGS. 1 and 2. Half the number of the total inking systems present is disposed in each of these halves. Thus the inking systems 6*a* to 6*e* are disposed in the right half 20, and the inking systems 6*f* to 6*j* are disposed in the left half 21. In a view of the components described above, every two inking systems that are located opposite to each other relative to the vertical center plane are symmetrical in construction. In printing presses of the prior art, the inking systems are constructed mirror-symmetrically. By contrast, the inking systems in a printing press of the invention are constructed rotation-symmetrically. This will become clear from the following description.

According to the invention, this rotational symmetry is manifested in that the drive motor 22*c* for the print roller 15*c* is disposed on the operating side BS of the printing press 1, the drive motor 22*h* for the print roller 15*h*, on the other hand, is disposed on the drive side AS. The inking systems 6*c* and 6*h* comprising the print rollers 15*c* and 15*h* respectively are disposed opposite to each other relative to the vertical center plane 19.

The drive motors 23*a* to 23*j* of the anilox rollers 16*a* to 16*j* are disposed at the respective other ends. Thus for example, if the drive motor of a print roller is disposed on the operating side, the drive motor of the anilox roller assigned to this print roller is disposed on the drive side.

Accordingly, the drives of the anilox rollers of every two inking systems located opposite to each other are also disposed on opposite sides of the printing press.

The arrangement of the drives of the inking system 6*h* thus results from the fact that this arrangement is carried out as in the case of the inking system 6*c*, but is rotated through 180 degrees relative to the inking system 6*c* about the axis of rotation 24.

It is particularly advantageous if the essential components of an inking system are identical and are simply disposed rotation-symmetrically on the opposite side of the center plane 19. These essential components can be referred to as functional components. In a view of these functional components, two opposite inking systems are substantially or even completely identical. However, it is obvious that these functional components do not include elements such as electric cables or ink-feed tubes since these are preferably laid on one side of the printing press, for example, the drive side. For example, electric cables are usually led to control cabinets disposed centrally Even the two parts 3*a* and 3*b* of the machine frame can be constructed rotation-symmetrically. It is also advantageous if a part of the machine frame, 3*a* and/or 3*b*, is actually divided into a right half and a left half 21, and these halves are then identical. In this case, the two identical halves of the printing press including the inking systems could first be pre-assembled and then assembled only subsequently for the construction of the printing press.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE NUMERALS

1 Printing press
2 Central impression cylinder
3*a*, 3*b* Machine frame
4 Printing substrate
5 Pressure roller
6*a* . . . 6*j* Inking system
7*a* . . . 7*j* Front bracket
8*a* . . . 8*j* Rear bracket
9*a* . . . 9*j* Bearing block for the print roller
10*a* . . . 10*j* Bearing block for the print roller
11*a* . . . 1l*j* Bearing block for the anilox roller
12*a* . . . 12*j* Bearing block for the anilox roller
13*a* . . . 13*j* Journal of the print roller
14*a* . . . 14*j* Journal of the print roller
15*a* . . . 15*j* Print roller
16*a* . . . 16*j* Anilox roller
17*a* . . . 17*j* Journal of the anilox roller
18*a* . . . 18*j* Journal of the anilox roller
19 Vertical center plane
20 Right half
21 Left half
22*a* . . . 22*j* Drive motor for the print roller
23*a* . . . 23*j* Drive motor for the anilox roller
24 Axis of rotation
B Direction of travel of the web
R Direction of rotation
AS Drive side
BS Operating side

What is claimed is:

1. A printing press comprising:

at least one impression cylinder having a first axial end and a second axial end, and to which at least a first inking system and a second inking system each having a corresponding print roller and a corresponding anilox roller are assigned, each of the print rollers being configured to be set against the impression cylinder and being driven via a drive, and each of the anilox rollers being configured to be set against the print roller and being provided with an independent drive, with a vertical center plane dividing the impression cylinder into a first half and a second half, and with the first inking system being assigned to the first half of the impression cylinder, and the second inking system being assigned to the second half of the impression cylinder, the drive of the print roller of the first inking system assigned to the first half of the impression cylinder being arranged on the first axial end of the impression cylinder, and the drive of the print roller of the second inking system assigned to the second half of the impression cylinder being arranged on the second axial end of the impression cylinder, and the drive of each of the respective anilox rollers being disposed at an end of the anilox roller that is located opposite to an end of the print roller at which the drive of the print roller is disposed.

2. The printing press as defined in claim 1, wherein the first inking system and the second inking system include functional components attached to a central frame of the printing press, and wherein the functional components of the first inking system and the second inking system are identical.

3. The printing press as defined in claim 1, wherein the first inking system assigned to the first half of the impression cylinder and the second inking system assigned to the second half of the impression cylinder, are identical.

4. The printing press as defined in claim 1, wherein the first half of the impression cylinder and the second half of the impression cylinder each include a plurality of the inking systems assigned thereto.

5. The printing press according to claim 2, wherein the functional components are inking system brackets.

6. A printing press comprising:

an impression cylinder having a first axial end and a second axial end;

a first inking system and a second inking system each having a corresponding print roller and a corresponding anilox roller, with the print roller having a print roller drive, and the anilox roller having an anilox roller drive, the first inking system being located on a first side of a vertical center plane of the impression cylinder and the second inking system being located on a second, opposite side of the vertical center plane of the impression cylinder, the print roller drive of the print roller of the first inking system being disposed at an end of the print roller corresponding to the first axial end of the impression cylinder, and the print roller drive of the print roller or the second inking system being disposed at an end of the print roller corresponding to the second axial end of the impression cylinder, and the anilox roller drive of the anilox roller of the first inking system being disposed at an end of the anilox roller corresponding to the second axial end of the impression cylinder, and the anilox roller drive of the anilox roller of the second inking system being disposed at an end of the anilox roller corresponding to the first axial end of the impression cylinder.

7. The printing press according to claim 6, wherein the first inking system and the second inking system each include a corresponding plurality of the print roller, the print roller drive, the anilox roller, and the anilox roller drive.

8. The printing press according to claim 7, further comprising functional components of the first inking system and the second inking system that are associated with a central frame of the printing press, wherein the functional components of the first inking system and the second inking system are identical and are disposed rotation-symmetrically on the opposite sides of the vertical center pane.

* * * * *